United States Patent [19]

Brazier

[11] Patent Number: 5,060,342

[45] Date of Patent: Oct. 29, 1991

[54] CLEANING HEAD

[75] Inventor: Alan J. Brazier, Inkberrow, United Kingdom

[73] Assignee: Vax Appliances Limited, Droitwich, United Kingdom

[21] Appl. No.: 326,548

[22] PCT Filed: Jul. 7, 1988

[86] PCT No.: PCT/GB88/00542

§ 371 Date: Mar. 10, 1989

§ 102(e) Date: Mar. 10, 1989

[87] PCT Pub. No.: WO89/00395

PCT Pub. Date: Jan. 26, 1989

[30] Foreign Application Priority Data

Jul. 10, 1987 [GB] United Kingdom ..... 8716295

[51] Int. Cl.[5] ..... A47L 5/28

[52] U.S. Cl. ..... 15/322; 15/401; 15/411; 15/417; 401/283

[58] Field of Search ..... 15/321, 322, 361, 401, 15/411, 417, 320, 344, 228, 244.3, 244.4; 401/288, 283, 286

[56] References Cited

U.S. PATENT DOCUMENTS

| | | | |
|---|---|---|---|
| 2,885,713 | 5/1957 | Morrill | 15/322 |
| 3,184,780 | 5/1965 | Hageman | 15/322 X |
| 3,195,166 | 7/1965 | Wisner | 15/322 X |
| 3,945,736 | 3/1976 | Rittenbaum et al. . | |
| 4,119,386 | 10/1978 | Cushing . | |
| 4,266,317 | 5/1981 | Duda | 15/322 |
| 4,437,203 | 3/1984 | Wisner . | |
| 4,596,061 | 6/1986 | Henning . | |

FOREIGN PATENT DOCUMENTS

| | | | |
|---|---|---|---|
| 2078496 | 1/1982 | Fed. Rep. of Germany . | |
| 3321592 | 12/1984 | Fed. Rep. of Germany . | |
| 841012 | 7/1960 | United Kingdom . | |
| 970512 | 9/1964 | United Kingdom | 15/417 |
| 994582 | 6/1965 | United Kingdom . | |
| 1074908 | 7/1967 | United Kingdom . | |
| 1576611 | 10/1980 | United Kingdom . | |

*Primary Examiner*—Frankie L. Stinson
*Attorney, Agent, or Firm*—Spencer & Frank

[57] ABSTRACT

A cleaning head adapted for use on hard surfaces comprises a body (10) formed as two back-to-back housings (20) and (30) which are swivellably mounted on a suction tube (40). Housing (20) contains a liquid applicator assembly (21) which comprises a body (22) of porous material with a facing layer of pile fabric (23). A cleaning liquid is delivered through ducts (46) and (48) to the body 22 so as to spread uniformly across the pile fabric (23). A suction slot (29) adjacent to the applicator assembly (21) may be provided to pick up dry dirt. The housing (30) includes a liquid pick-up assembly (31) comprising a slot (32) between a pair of flexible blades (33*a*,33*b*).

7 Claims, 2 Drawing Sheets

CLEANING HEAD

BACKGROUND OF THE INVENTION

This invention relates to a cleaning head for use with apparatus for cleaning floors, walls or the like surfaces, more especially hard surfaces, by the application of a suitable cleaning liquid. More specifically, the invention is concerned with a cleaning head which is adapted for the distribution of such a cleaning liquid on to a hard surface and preferably also adapted for use in picking-up or collecting the soiled liquid by means of suction.

The requirements of such cleaning heads for use on hard surfaces differ significantly from cleaning heads for carrying out a similar operation on a soft surface, such afforded by carpet or upholstery, in the same way that different suction heads are needed for dry suction cleaning operations on different surfaces, such as hard or soft respectively.

SUMMARY OF THE INVENTION

Cleaning of hard floors is achieved more by the use of chemicals than mechanical or physical effort and floors tend to be mopped rather than scrubbed. However, the problem with conventional mopping is that of using the cleaning solution to rinse out the mopping head which is then squeezed out into the cleaning solution, quickly degrading the cleaning solution into the dirty water. The object of the invention is to provide a mopping head which allows clean cleaning solution to be used continuously and if the same cleaning solution, which having been applied to the surface to be cleaned, remains there for a short duration of time, giving the cleaning solution time to break down the dirt and grease attached to the surface and holds it in suspension.

The present invention provides an improved cleaning head for use in wet process cleaning operations on hard surfaces, which cleaning head has one or more of the following features:

an applicator for applying a cleaning liquid to a hard surface, said applicator comprising an operative surface of densely packed thin flexible filaments, for example afforded by a pile fabric, and a distributor body comprising a porous medium such as a body of foamed plastics material, and a liquid supply conduit arranged to deliver the cleaning liquid to said body; such applicator is disposed in a housing which defines a suction chamber for connection to a source of suction, the housing affording an air inlet adjacent to at least one edge of said applicator so as to be adapted to pick-up dry material from the surface being cleaned whilst the applicator is in use;

a brush of relatively harder material than the applicator operative surface arranged at at least one edge of said applicator, preferably at least at the edge opposite that at which said air inlet is arranged; a liquid pick-up housing comprising a suction chamber affording an air inlet in the form of a slot provided with flexible blades along its opposed side edges, such blades preferably being formed with parallel grooves on the faces which are presented outwardly of the slot.

BRIEF DESCRIPTION OF THE DRAWINGS

These and other features in accordance with the invention will now be described by way of example with reference to one embodiment of cleaning head in accordance with the invention and as shown in the accompanying drawings wherein.

DESCRIPTION OF THE PREFERRED EMBODIMENT

Figure 1:
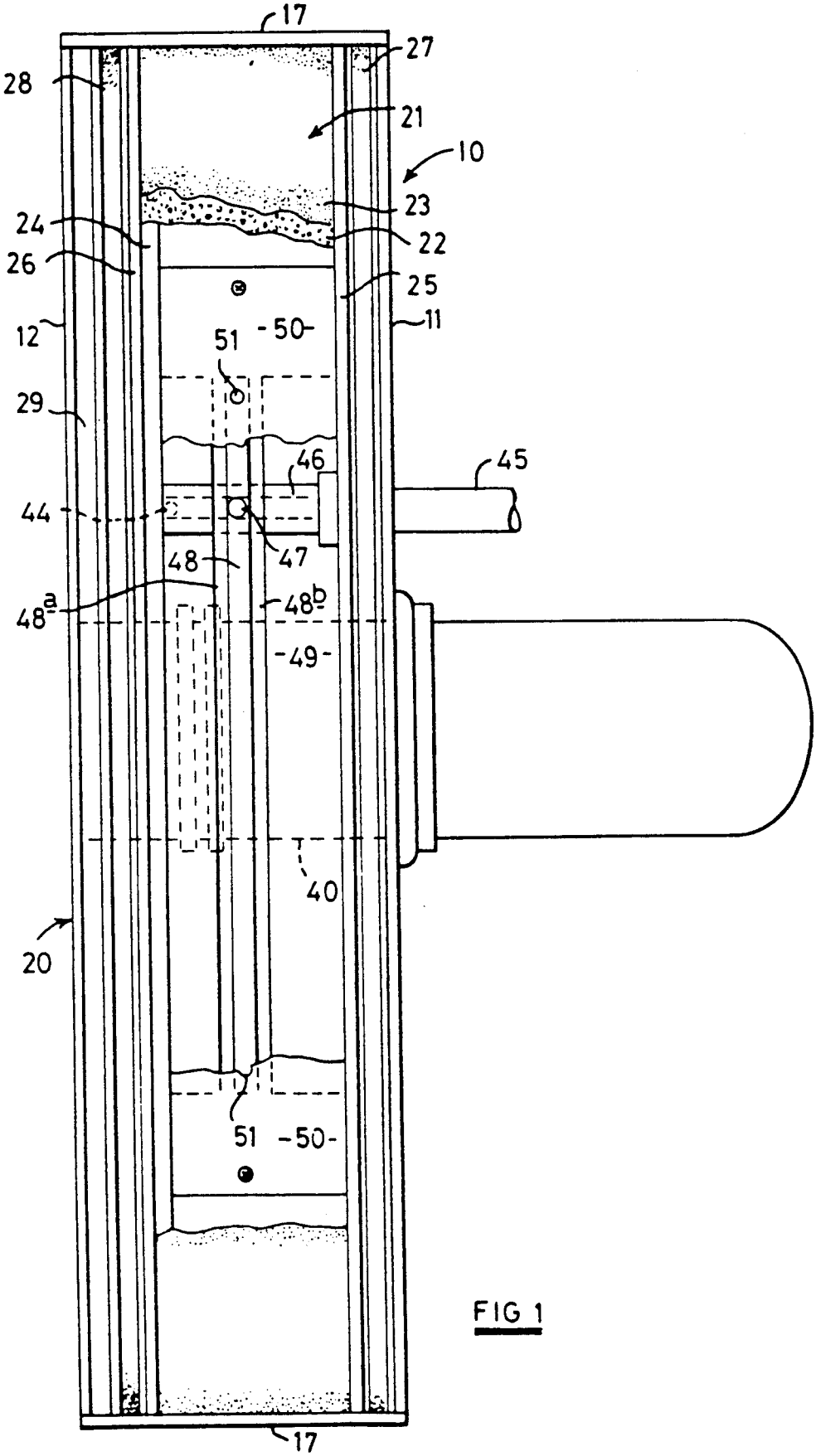
FIG. 1 shows a partially cut away underneath plan view of such cleaning head for the application of a cleaning liquid.
Figure 2:
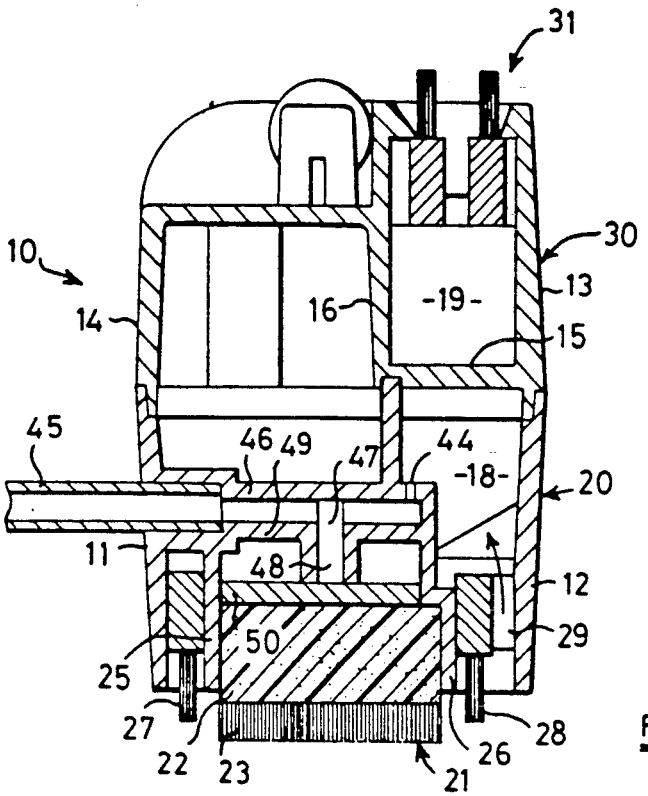
FIG. 2 is a transverse section through the cleaning head on the line of a liquid delivery inlet.

As shown in the accompanying drawings, a preferred embodiment of a cleaning head in accordance with the invention comprises a rectangular body 10 which defines a first housing 20 with an applicator assembly 21 at the mouth thereof, the interior of the housing comprising a suction chamber 18, and a second housing 30 provided with a pick-up assembly 31, and defining internally a further suction chamber 19, the two suction chambers being separated by an interal wall 15 within the body 10. The head is mounted in a swivelable manner on a suction tube 40 which has a downwardly directed opening 41 which communicates with the suction chamber which is, for the time being, in contact with the surface to be cleaned. The suction tube is connected to a flexible hose (not shown) which is in turn connected to a source of suction in a conventional manner. A flexible pipe 45 serves as a liquid supply tube and is equipped with a manually operable valve (not shown) whereby cleaning liquid can be delivered under the users control from an appropriate reservoir. The applicator assembly 21 comprises a porous body 22 of foamed plastics material faced with a layer of pile fabric 23, the preferred material for the pile being mohair. The applicator assembly 21 is housed within a cavity 24 defined by a pair of ribs 25,26 which are spaced inwardly from side walls 11,12 of the housing 20. Bristle brushes 27,28 are mounted adjacent to the ribs 25,26 as shown and a suction gap 29 is afforded between the brush 28 and side wall 12. The bristles of these brushes 27,28 are made of a harder, stiffer material than the pile material 23, but the arrangement is such that the pile fabric is, as shown in FIG. 2, normally disposed at a lower level than the bristles of brushes, i.e. the pile fabric 23 protrudes below the brushes 27,28.

The liquid supply pipe 45 is inserted into the open end of a liquid inlet duct 46 which extends parallel to the end portion of the tube 40 on which the body 10 is mounted. An aperture 47 extends between the inlet duct 46 and a distribution duct 48 which extends medially within the head. The duct 48 is formed by a pair of spaced ribs **48*a*,48*b* on one side of a transverse web 49 and is closed by means of a plate 50. The plate 50 is formed with apertures 51 adjacent to the ends of the duct 48 and forms the inner boundary of the cavity 24 so that liquid delivered through ducts 46 and 48 is applied through apertures 51 to the porous body 22**.

A bleed hole 44 is formed adjacent to the end of the inlet duct 46 to communicate with the interior of the suction chamber 18 to vent air from the liquid supply tube and duct 46.

In use, the applicator assembly 21 is applied to the hard surface to be cleaned an the manual control valve is operated so as to allow cleaning liquid to be supplied to the porous body 22. The liquid percolates through the porous body 22 and is distributed substantially uniformly to the pile fabric 23 through which it is applied onto the surface being cleaned.

The air suction gap 29 enables a current of air to be established immediately adjacent to the applicator assembly 21 so as to pick up any loose dust or fibres on the surface, in the manner of a conventional dry suction cleaner head. For this purpose, when the applicator assembly 21 is operative the opening 41 at the end of the suction tube 40 communicates with the suction chamber 18 within the first housing 20, the gap 29 opening into the chamber 18.

The brushes 27,28 serve two purposes. Firstly, they limit the inward movement of the pile fabric 23 in response to pressure applied to the cleaning head by the user, and secondly they provide a scrubbing action on the wetted surface.

The fine soft filaments or fibres of the pile fabric 23 are effective to penetrate into small crevices in the hard surface being cleaned and provide a more efficient and gentler cleaning action than conventional scrubbing machines which use relatively course and hard bristles which less effectively penetrate small crevices and can more easily damage the surface being cleaned. The bristles of the brushes 27,28, however, enable the user to carry out a gentle scrubbing operation when required, whereas the suction gap 29 ensures that loose dirt is removed rather than remaining on the surface and therefore containing the cleaning liquid as it is applied to the surface.

When an area of the surface being cleaned has been wetted and adequately cleaned by the application of the liquid using the applicator assembly 21, the body 10 is swivelled about the suction tube 40 so that the pick-up assembly 31 is presented to the surface and the suction chamber 19 of the second housing 30 is exposed to the inlet opening 41 of the suction tube 40.

Figure 3:
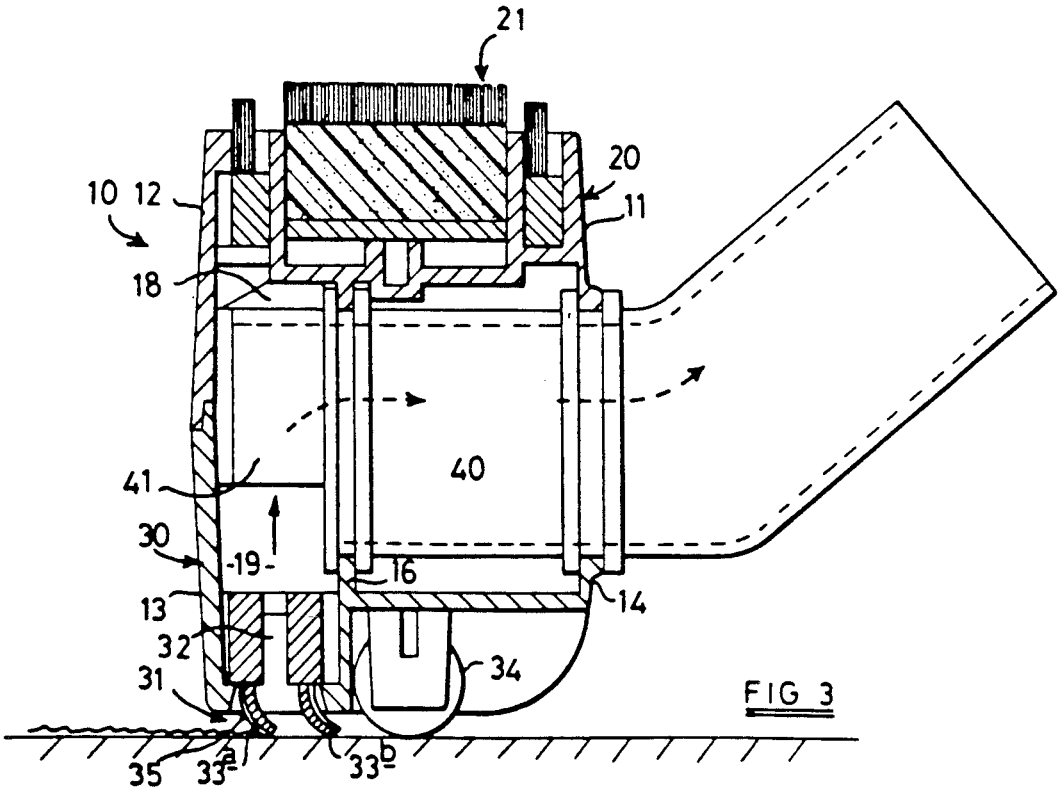
FIG. 3 is a transverse section through the head on the centre line with the head inverted as compared with FIG. 2 and in use for the collection of soiled liquid.

As best seen in FIG. 3, the housing 30 comprises side walls 13,14 and an intermediate wall 16 and the suction chamber 19 is defined beteen walls 13 and 16. Air is thus drawn in through the pick-up assembly 31 which comprises a slot 32 extending across substantially the entire transverse width or the body 10 and up to end walls 17. Flexible blades **33*a*,33*b* are provided along the opposed side edges of the slot 32. Such blades provide a wiping action which assists in collecting the soiled liquid from the surface being cleaned. Preferably, the outermost faces of the blades 33*a*,33*b* are formed with parallel grooves 35 which extend transverse to the length of the blades, i.e. perpendicularly to the surface being cleaned. Such grooves provide channels which are open at the free edges of the blades. When the cleaning head is being pushed forwardly, as shown in FIG. 3, such channels are at the underside of the leading blade 33*a* and therefore allow water on the surface to be drawn into the space between the blades so as to be drawn into the suction chamber 19**, whereas the corresponding grooves on the trailing blade are on the upper face thereof, with the result that the lower, or inner face scrapes over the surface so as to prevent water escaping before it can be picked up. When the head is moved in the opposite direction, a similar effect is obtained by virtue of the bodies flexing in the opposite direction.

As shown, wheels 34 may be provided to assist movement of the lead over the surface when the pick-up assembly is operative.

Typically, the cleaning head may have a transverse width of between about 20 and 30 cm, and in practice it has been found that the cleaning liquid is distributed substantially uniformly across the entire area of the applicator from the two outlet apertures 51 of the distribution duct 48 which are spaced equally on opposite sides of the centre line, the porous body 22 serving to ensure that the liquid spreads evenly from the two localised points of delivery to cover the entire area of the pile fabric 23. However, if desired, the distribution duct 48 tube 21 could be formed with intermediate outlets.

Whilst it is advantageous to provide the suction gap 29 adjacent to the applicator assembly 21, the gap 20 need not be provided in any case where pick-up of dry material is not required. In that case, it will be appreciated that the interior of the second housing 30 would not be required to constitute a suction chamber and need not be in communication with the interior of the suction tube 40, which would be modified accordingly. For example, the housings 20 and 30 could be affored by separated cleaning heads, one of which affords the housing 20 associated with the applicator assembly 21 and the other of which affords the housing 30 associated with the pick-up assembly 31, such heads alternatively being connected to the flexible hose, although when the first housing 20 with the applicator assembly 21 is in use the suction motor should be de-energised, or alternatively the housing should afford an air inlet for example at a position above the applicator assembly so that air flow is maintained in the flexible hose 42 to prevent overheating of the suction motor.

The liquid may be supplied to the inlet duct 46 in any convenient manner, in particular by displacment from the reservoir by means of the application to the reservior of exhaust air from an impellor employed to create the required suction, as described and claimed in our British patent No. 1601456. Alternatively, the liquid may be supplied by a gravity feed system or by a pressurised delivery system. In a further alternative the liquid may be drawn from a reservoir by virtue of suction applied to the inlet duct 46 by way of the bleed hole 44.

I claim:

1. A cleaning head for use with apparatus for cleaning hard surfaces by the application and optionally pick-up of a cleaning liquid, said cleaning head comprising an applicator assembly including a compressible porous body having an operative facing layer formed by a pile fabric, a liquid supply duct arrange to deliver such liquid to said porous body so that the liquid percolates through said porous body and said facing layer, a brush of relatively harder material than the facing layer arranged at at least one edge of said applicator assembly, and the facing layer of said applicator assembly being normally disposed so as to project outwardly, from the housing beyond the brush, the latter serving to limit inward displacement of the facing layer when in use.

2. A cleaning head according to claim 1, wherein the applicator assembly is disposed in a housing which defines a suction chamber connectable to a source of suction, said housing includes means defining an air inlet, and said air inlet is disposed adjacent to at least one edge of said applicator assembly to enable dry material to be picked up from the surface being cleaned by suction simultaneously with the application of said liquid by means of the applicator assembly.

3. A cleaning head according to claim 2, wherein a further housing includes means defining a suction chamber and affording an air inlet in the form of a slot provided with flexible blades along its opposed side edges for the pick-up of liquid from the surface being cleaned.

4. A cleaning head according to claim 3, wherein said blades are formed with parallel grooves on the faces thereof which are presented outwardly of the slot so as to enable water to be drawn under the end edge of the respective blade when said outwardly presented faces adopt a convex configuration due to movement of the cleaning head over the surface being cleaned.

5. A cleaning head according to claim 3, wherein the housing and the further housing are mounted in back-to-back relationship within a body which is swivellably mounted on a suction tube whereby either the housing containing the applicator assembly or the further housing with the liquid pick-up slot can be presented to the surface to be cleaned at the option of the user.

6. A cleaning head according to claim 5, wherein the suction tube is formed with a laterally directed opening which is arranged to communicate alternatively with the suction chamber within the housing or the suction chamber within the further housing dependent on the position of the body relative to the tube.

7. A cleaning head for use with apparatus for cleaning hard surfaces by the application and optionally pick-up of a cleaning liquid, said cleaning head comprising an applicator assembly including a compressible porous body having an operative facing layer formed by a pile fabric, a liquid supply duct arranged to deliver such liquid to said porous body so that the liquid percolates through said porous body and said facing layer, a brush of relatively harder material than the facing layer arranged at at least one edge of said applicator assembly, said applicator assembly being disposed in a housing, said housing having means defining an air inlet in said housing, and a further brush being disposed at the edge of the applicator assembly opposite to that at which the air inlet is provided.

* * * * *